US006269577B1

(12) United States Patent
Hardy

(10) Patent No.: US 6,269,577 B1
(45) Date of Patent: Aug. 7, 2001

(54) HAND GRIP REMOVAL ASSIST

(76) Inventor: David John Hardy, 11000 Gatesden, Apt. 1603, Tomball, TX (US) 77375

( * ) Notice: Subject to any disclaimer, the term of this patent is extended or adjusted under 35 U.S.C. 154(b) by 0 days.

(21) Appl. No.: 09/431,381

(22) Filed: Nov. 1, 1999

(51) Int. Cl.[7] ..... F41C 27/00
(52) U.S. Cl. ..... 42/90; 42/127; 42/143; 42/71.01; 42/72; 89/1.42
(58) Field of Search ..... 42/101, 90, 85, 42/75.02, 75.01; 33/250, 247, 252

(56) References Cited

U.S. PATENT DOCUMENTS 4,258,941 * 3/1981 Sands ..... 285/197
4,536,982 * 8/1985 Bredbury et al. ..... 42/71
4,641,451 * 2/1987 Harris ..... 42/85
4,663,875 * 5/1987 Tatro ..... 42/71.01
4,756,111 * 7/1988 Lapier ..... 42/101
4,776,126 * 10/1988 Williams ..... 42/101
4,819,289 * 4/1989 Gibbs ..... 7/118
4,982,522 * 1/1991 Norton ..... 42/85
5,010,676 * 4/1991 Kennedy ..... 42/71.01
5,101,590 * 4/1992 Hawkins ..... 42/101
5,315,781 * 5/1994 Beisner ..... 42/101
5,353,831 * 10/1994 Roth ..... 137/318
5,680,725 * 10/1997 Bell ..... 42/101
5,802,755 * 9/1998 Tortorici et al. ..... 42/75.02
5,826,363 * 10/1998 Olson ..... 42/75.01
5,971,001 * 10/1999 Andersson ..... 137/15

* cited by examiner

*Primary Examiner*—Charles T. Jordan
*Assistant Examiner*—Denise J Buckley
(74) *Attorney, Agent, or Firm*—Robert W.B. Dickerson

(57) ABSTRACT

A tool to assist in the field removal of a rifles's hand grips or hand guards, comprising a pair of releasably joined split ring segments which are adapted to urge the slip ring of a rifle away from the rifle's mounting ring, thereby freeing the rifle's hand grips. Elastic means are provided linking the device with the rifle's stock thereby permitting pressure to continuously urge the slip ring away from the mounting ring.

2 Claims, 5 Drawing Sheets

HAND GRIP REMOVAL ASSIST

BACKGROUND OF THE INVENTION

Modern American field weaponry, specifically its field rifles, as exemplified by the M-16 and AR-15 may fire rapidly. This generates intense heat in its barrel. If a user were to touch the barrel, severe bums may result. Thus, hand guards are provided and elaborate gas dissipation systems have been developed. Nevertheless, weapons must be disassembled for cleaning purposes. In the field, heretofore, this has usually required two or more personnel to remove the hand guards and hold the stock. Sometimes this may not be possible. Thus it would clearly be advantageous to permit a single person, the user, to dissemble the hand guards and thereby be able to clean the device. This problem has been dealt with by this invention.

SUMMARY OF THE INVENTION

The purpose of this invention is to assist in the ready removal of hand grips from various weapons, primarily rifles such as the M-16 and AR-15. It comprises a new tool that will attach to the slip ring, using a cable to exert a force on the slip ring and allow the cable to be locked in position by hooking it behind the stock of the weapon.

Among the advantages of this tool is that it can be left on the weapon while cleaning the barrel, and also while the weapon is in active use. It does not have to be removed to fire the weapon.

Another advantage of the tool is that it will allow a single individual to perform a function that currently requires two persons. At this time, one person must pull down the slip ring, while a second person removes the hand grip from the barrel. In order to reassemble the weapon the same procedure must be performed in reverse.

The tool works in a fashion similar to a crossbow, in that a cable or rope is drawn back and locked behind the stock of a weapon. When the cable is drawn back, pressure is applied to the slip ring, which disengages, and allows the hand grip to be released for removal. This allows the handler to remove the hand grip on his own, as well as to reinstall it. This tool eliminates the need for a second person to help perform the task. It will save time and manpower in the field.

DESCRIPTION OF THE INVENTION

Figure 2:
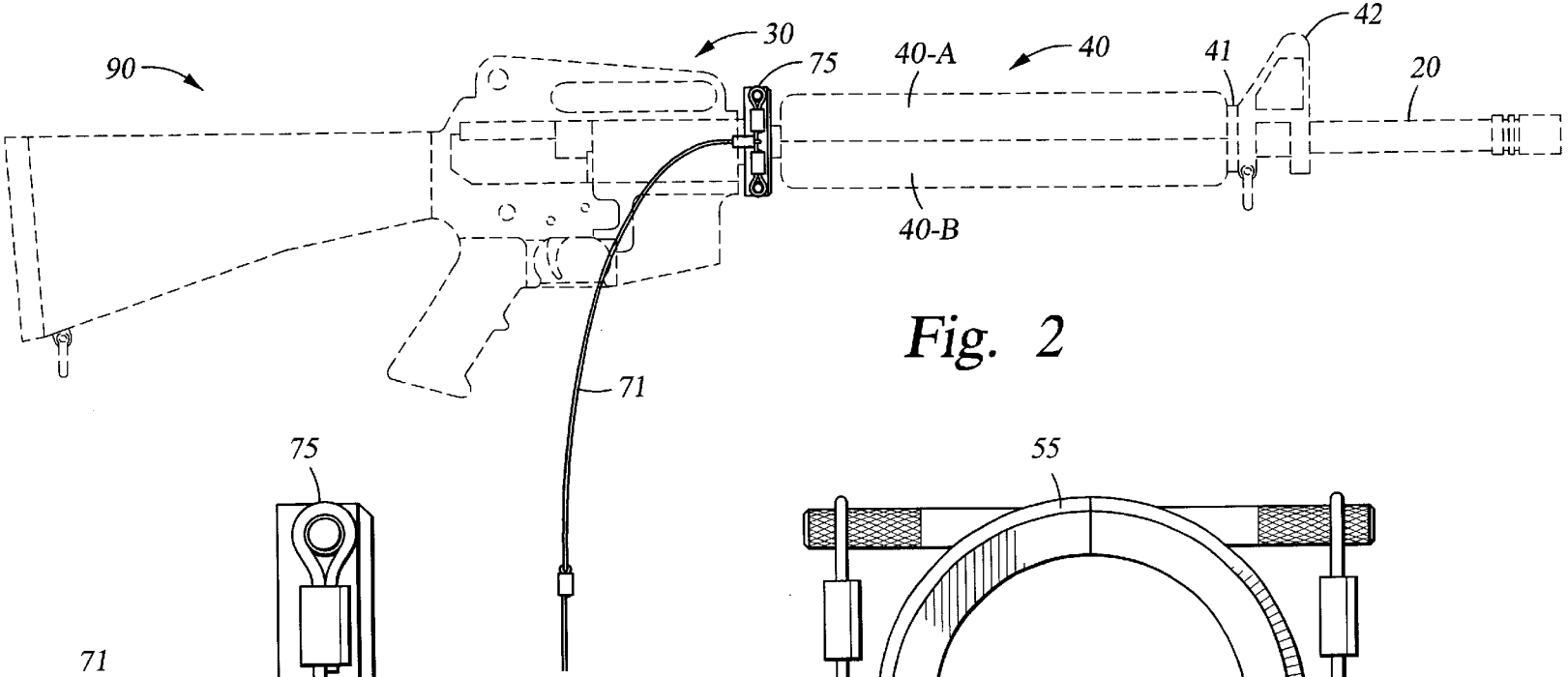
FIG. 2 is a side view of the tool, partly broken, shown attached to a rifle illustrated in phantom lines.
Figure 4:
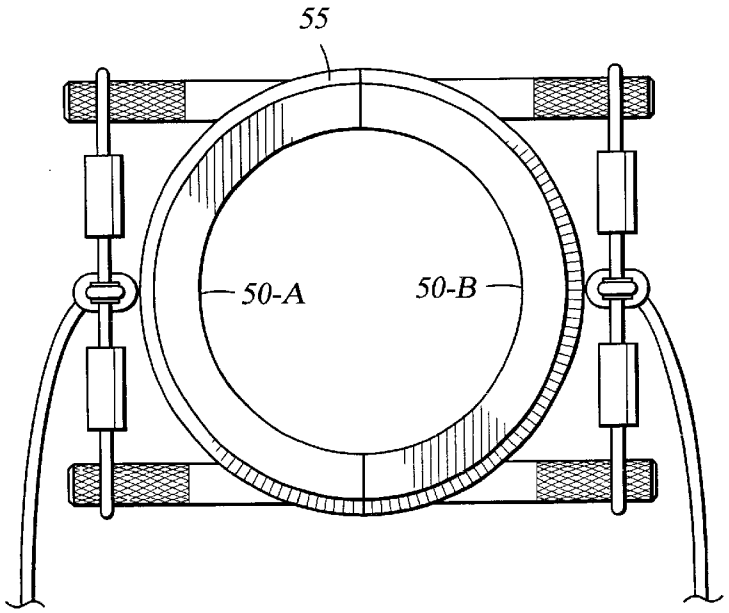
FIG. 4 is a front plan view of the split ring and the connector of FIG. 1, the cable portion being broken.
Figure 3:
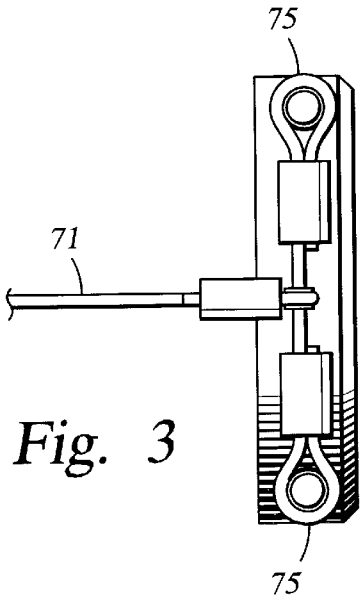
FIG. 3 is an enlarged, detail plan of the portion of the connector shown in FIG. 2.
Figure 5:
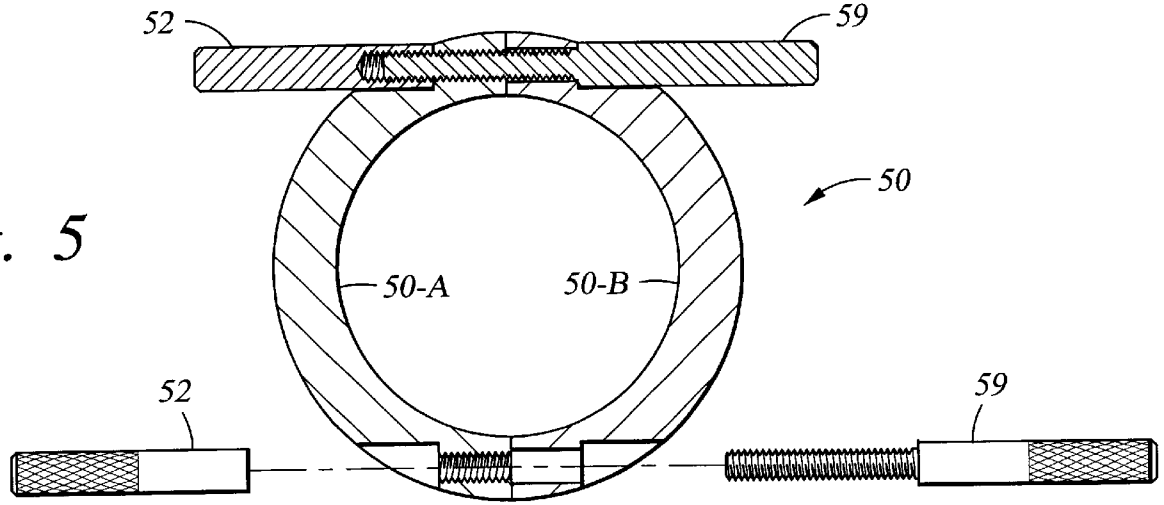
FIG. 5 is a vertical section through the split ring and one set of fasteners, the other set shown in exploded fashion.
Figure 7:
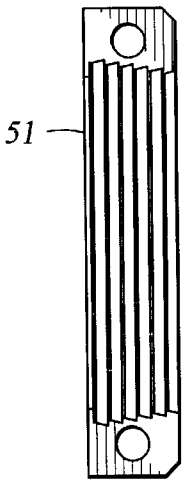
FIGS. 6 and 7 are Axial sections through the split ring of two separate embodiments, one for use with a slip ring of uniform diameter, and the other for use with decreasing diameter from rear to front.
Figure 6:
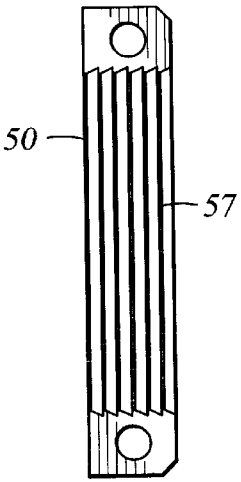
Figure 9:
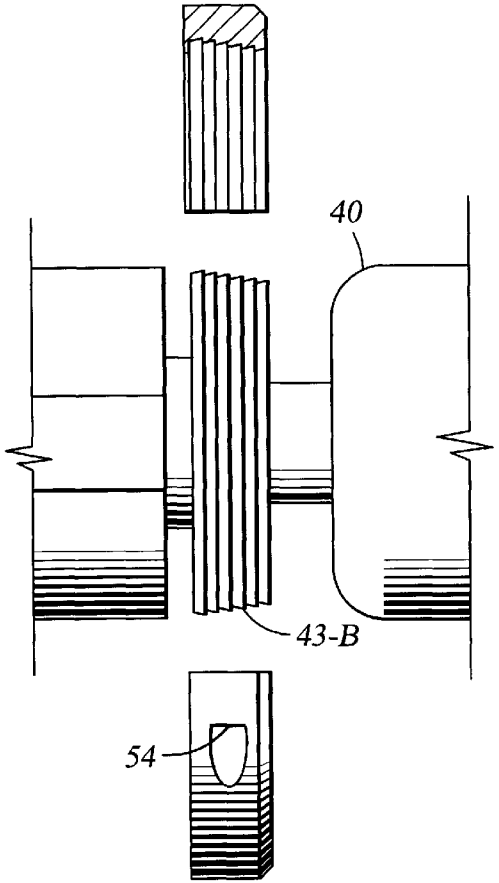
FIGS. 8 and 9 are partly broken elevations of two different slip rings positioned in rifles so as to accommodate the separate split ring devices of FIGS. 6 and 7 respectively.
Figure 8:
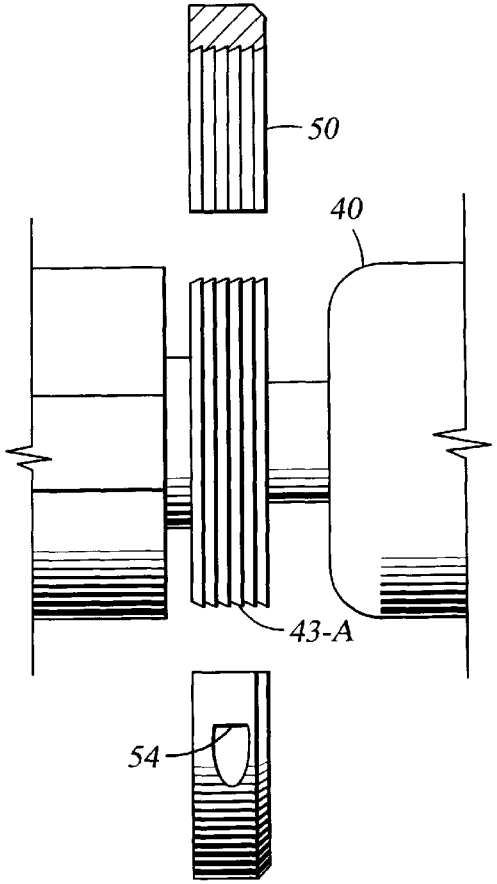

Initially, consider FIGS. 2, 8 and 9, and particularly the rifle shown therein.

Conventional rifles, such as an M-16 or an AR-15, include a stock 90, a barrel 20, and receiver 30. Adjacent the receiver, the barrel is provided with a hand grip or guard 40, which is usually bifurcated axially, for obvious reasons, into sections 40-A and 40-B. This invention is directed to permitting one person to easily remove this hand guard from the barrel, while in the field.

Near one end of hand guard 40, mounting ring 41 includes a depending skirt (not specifically shown) which is movably slidable on barrel 20 and receives a depending partial skirt from each hand guard half. The mounting ring, in turn, abuts combination ramp sight and sling connection 42, which may be secured to the barrel, thereby prohibiting further axial movement of the mounting ring and the hand guard to the right, in FIG. 2. Moving now to the left of FIG. 2, and more particularly to FIGS. 8 and 9, the hand guard is releasably secured to receiver 30, via slip ring 43-A or 43-B. These slip rings are limitedly axially movable along skirts depending from guard segments 40-A and 40-B. This movement is controlled by an internal spring mechanism, not shown. The slip ring is spring biased by said mechanism toward the hand guard 40, but may be urged and moved toward receiver 30, thereby releasing said guard segments' skirts from within the slip ring. The mechanism comprising the rifle described thus far is not claimed to be new, save for the varying diameter slip ring of FIG. 9, more specifically detailed hereafter. A conventional rifle, such as that illustrated in U.S. Pat. No. 5,010,676 illustrates the internal spring mechanism discussed above, but not forming a part of the invention, as such.

Figure 1:
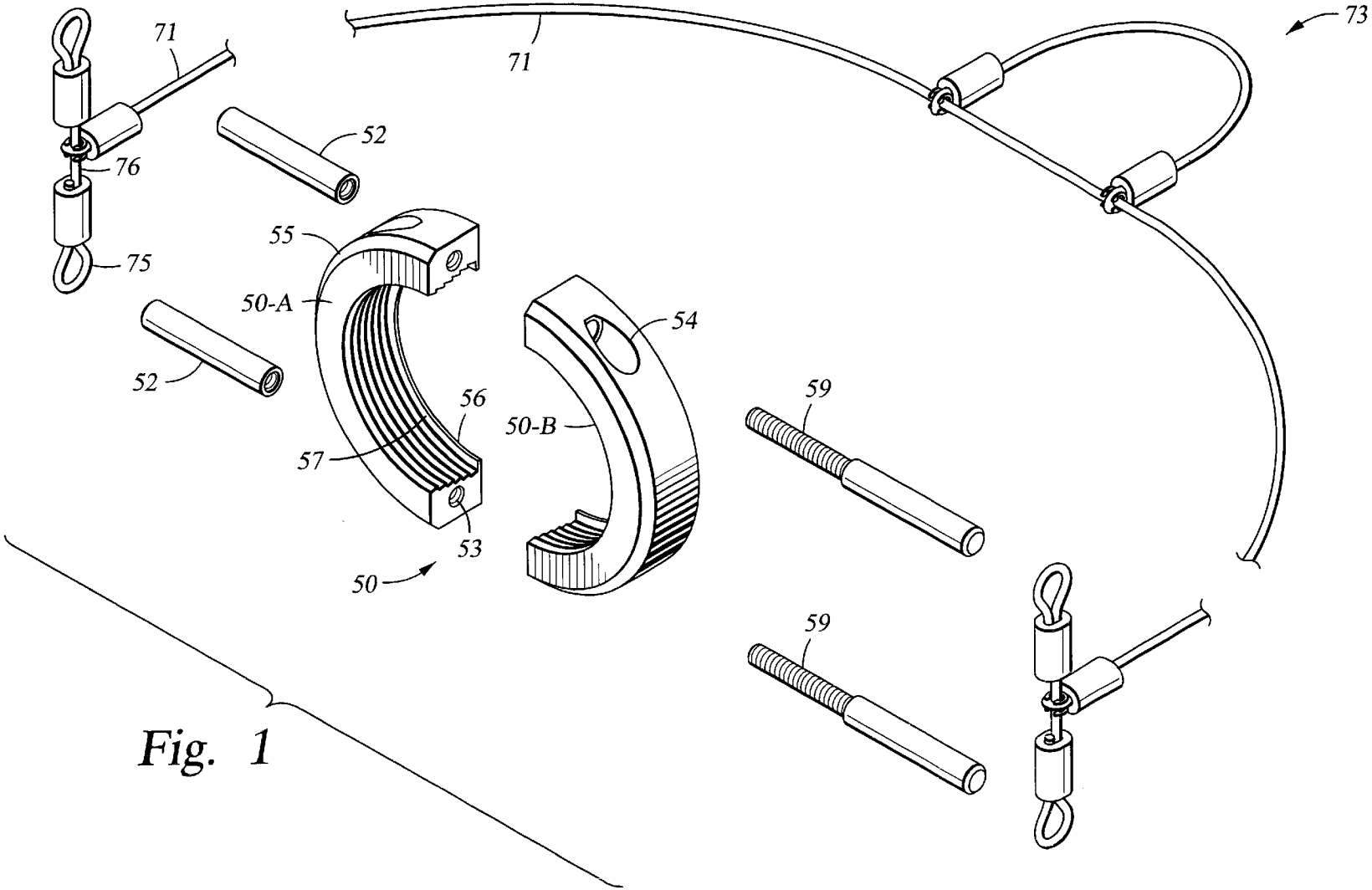
FIG. 1 is an exploded, party broken, perspective, of the split ring, fasteners, and one embodiment of the connector, comprising the tool of this invention.

Move now to that which does comprise the invention. It does comprise structure permitting the hand guard 40 to be removed by one person. It does this by exerting a force against slip ring 43-A or 43-B. The structure permitting the same is best shown in FIG. 1.

The split ring is joined to either embodiment of a connector.

Figure 10:
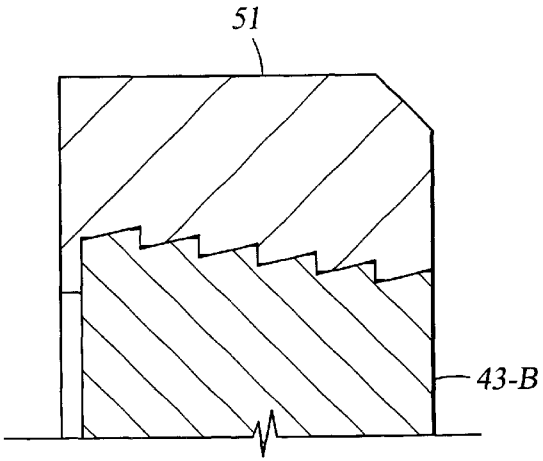
FIG. 10 is a vertical section through the assembled split ring of FIG. 7 and slip ring of FIG. 9.

The central component is the split ring or collar 50 or 51. The only difference between these two variations lies in the fact that ring 50 has a uniform thread diameter, while such thread diameter of ring 51 tapers, i.e., decreases from left to right in FIGS. 9 and 10. This latter variation is designed to accommodate those rifles having an accommodatingly configured slip ring. Other than in discussing FIGS. 9 and 10, most of this description will be written in the context of a uniform diameter slip ring and split ring.

Ring 50, or 51, includes two similar halves numbered 50-A and 50-B. These halves, or segments, are removably joined by a pair of externally threaded male fasteners 59 and a further pair of internally threaded female fasteners 52. Tangentially oriented passageways 53 are provided to ring segment 50-A. These passageways may be threaded or may receive an internally threaded bushing (not shown). The internally threaded female fastener would rest against the bushing. The ring segment 50-B has opposed unthreaded, tangentially oriented passageways 54 (only one shown in FIG. 1), to receive the male fasteners' threaded portion there through. Thus, the split ring when assembled may clamp the external periphery of slip ring 40.

Note the presence of annular chamferred face 55 extending around one side of both segments 50-A and 50-B. This chamferred face faces the front, or ramp sight 42 end, of the rifle. Likewise, note depending annular lip 56 extending around the inner or rear face of said ring segments. This lip assures the desired range of motion of the split ring in certain rifles, i.e., the inventive tool (split ring 50) is prevented by the slip ring from moving forwardly of said slip ring. As described later, the tool grasps or clamps the slip ring, with the beveled face 55 facing forwardly and the lip 56 at the rear of the slip ring which extends radially inward of the aforementioned serrations. Internal serrations or threads 57 (forming peaks and valleys) as formed on split ring 50. Note that the internal serrations of one embodiment of split ring 50 includes equal diameter serrations to match the similar configuration of slip ring 43-A. (See FIG. 8). Likewise, the split ring 51 of FIG. 9 includes a varying diameter set of serrations to match the like configuration of slip ring 43-B. Note that lip 56 is of lesser internal diameter than the adjacent serrations, i.e., extends more radially than do the serrations.

To this point, the tool, sans connector, may be assembled on the rifle. The two sides 50-A and 50-B are positioned encircling the slip ring 43-A or 43-B. Male fasteners 59 have their threaded ends inserted through passageways 54 of member 50-B, threadedly engage passageway 53 (or a bushing inserted therein) and threadedly engage female fastener 52 which would be positioned adjacent threaded passageway 53, or its bushing. The threads or serrations of the split ring would have been chosen so as to match those of the slip ring.

Consider now the connector or harness portion of the invention, disconnecting the hand guard from the barrel. Two embodiments of this connector are illustrated.

Figure 12:
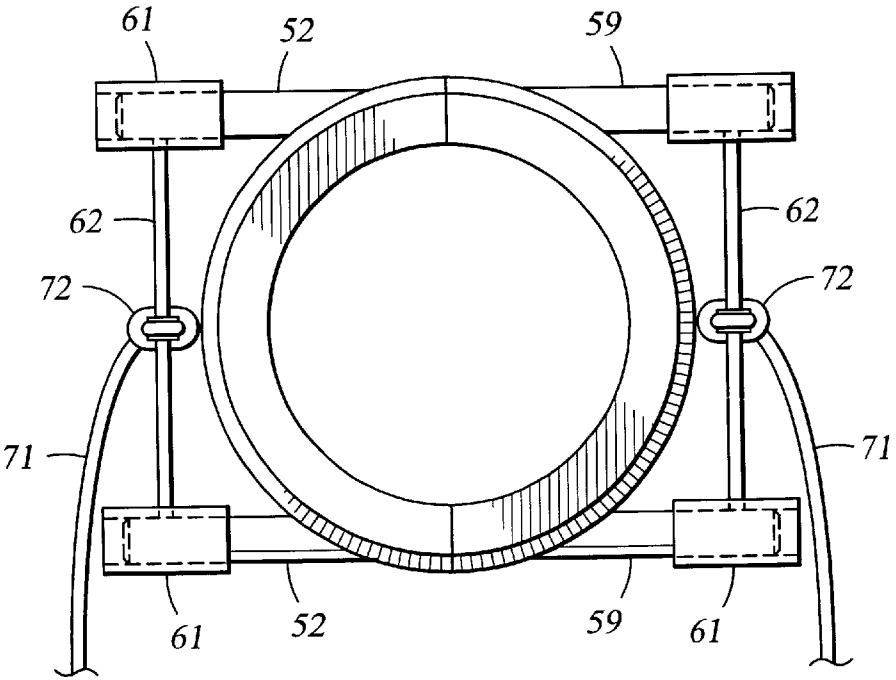
FIGS. 11 and 12 respectively are an isometric view of a broken part of a split ring segment and connector, and an elevation of an assembled split ring and a broken part of said connector, both figures depicting a second connector embodiment.
Figure 11:
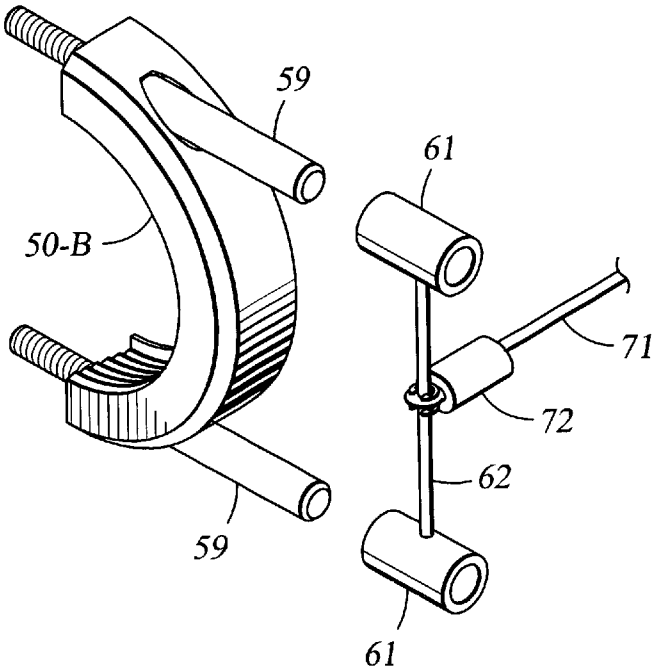

In the embodiment of FIGS. 11 and 12, a field goal appearing device is attached to the unthreaded end of male fasteners 59. A like device is positioned on the unthreaded end of female fasteners 52. Each such goal device includes a pair of spaced skirts 61 linked by a rod or like linking member 62. An elastic cable or rope 71 is hooked, clamped, or otherwise linked to member 62, by a clamp or other tethering means 72. An elastic handle 73 (see FIG. 1) allows the user to pull rope 71 around and secure rope 71 around the rifle stock, thereby withdrawing the slip ring from locking the hand guard shirts.

The alternate connector embodiment of FIG. 1 includes the rope 71 and handle 73 previously described. Instead, however, of using the skirts 61, to secure rope 71 to female fasteners 52, this embodiment utilizes a pair of nooses 75 linked by a shaft 76, to which shaft rope 71 is connected. This arrangement also permits pulling the slip ring away from the hand guard's skirts, allowing the guards to be removed.

Although limited embodiments have been described, it should be obvious that numerous modifications would be possible by one skilled in the art without departing from the spirit of the invention, the scope of which is determined by the following claims.

What is claimed is:

1. A tool for urging a rifle's slip ring toward the stock of said rifle, said tool comprising:

a split ring, cylindrical collar having a pair of opposed sections and means for releasably securing said sections together, said securing means including a pair of fastener passageways in each section, and a pair of each of male and female fasteners releasably engageable with each other; and said collar including serrations adapted to be compatible with external serrations provided said rifle's slip ring; and each split ring collar section includes a semi-annular lip of greater depth than the adjacent serrations.

2. A tool for urging a rifle's slip ring toward the stock of said rifle, said tool comprising:

a split ring, cylindrical collar having a pair of opposed sections and means for releasably securing said sections together, said securing means including a pair of fastener passageways in each section, and a pair of each of male and female fasteners releasably engageable with each other; and said collar including internal serrations adapted to be compatible with external serrations provided said rifle's slip ring; and said elastic member includes an offset handle portion.

* * * * *